US009579587B1

(12) United States Patent
Chen et al.

(10) Patent No.: US 9,579,587 B1
(45) Date of Patent: Feb. 28, 2017

(54) INFLATABLE TOYS HAVING INTERCHANGEABLE PARTS

(71) Applicant: RC Research LLC, Flemington, NJ (US)

(72) Inventors: Richard Chen, Flemington, NJ (US); Anne Murphy, East Northport, NY (US); Crystal Typermass, Flemington, NJ (US); Jessica Van Zee, Flanders, NJ (US)

(73) Assignee: RC Research LLC, Flemington, NJ (US)

( * ) Notice: Subject to any disclaimer, the term of this patent is extended or adjusted under 35 U.S.C. 154(b) by 0 days.

(21) Appl. No.: 15/185,286

(22) Filed: Jun. 17, 2016

(51) Int. Cl.
*A63H 33/30* (2006.01)
*A63H 33/00* (2006.01)
*A63H 27/10* (2006.01)

(52) U.S. Cl.
CPC ..... *A63H 33/009* (2013.01); *A63H 27/10* (2013.01); *A63H 2027/1033* (2013.01)

(58) Field of Classification Search
CPC ..... A63H 27/10; A63H 2027/1041; A63H 2027/1075; A63H 33/009
See application file for complete search history.

(56) References Cited

U.S. PATENT DOCUMENTS 2,669,062 A 2/1954 Baggott
3,066,439 A 12/1962 Lemelson
4,080,751 A 3/1978 Copstead
4,678,450 A 7/1987 Scolari et al.
5,145,446 A 9/1992 Kuo
5,186,675 A 2/1993 Stoddard
5,240,449 A 8/1993 Sloan et al.
5,295,926 A * 3/1994 Tanabe ..... F41B 13/02 446/473
5,321,591 A * 6/1994 Cimock ..... H05B 39/09 315/200 A
5,598,596 A * 2/1997 Jones ..... A47L 13/16 15/1.52
5,947,789 A 9/1999 Chan
6,036,576 A 3/2000 Colon, Jr.
6,082,876 A 7/2000 Hanson et al.
6,186,857 B1 * 2/2001 Gazit ..... G09F 15/0025 40/406
6,428,185 B1 * 8/2002 Lin ..... F21V 1/06 362/253
7,198,538 B2 4/2007 Chin-Cheng
7,476,141 B2 1/2009 Hom
7,611,398 B2 11/2009 Woodhouse
2006/0286892 A1 12/2006 Moomaw
2007/0270077 A1 11/2007 Woodhouse
2008/0045117 A1 2/2008 Marin Hernandez
2008/0051003 A1 2/2008 Hom
(Continued)

*Primary Examiner* — John Ricci
(74) *Attorney, Agent, or Firm* — Doherty IP Law Group LLC

(57) ABSTRACT

An inflatable toy sword includes a handle having a proximal end and a distal end, a fan disposed in the handle for directing air toward the distal end of the handle, a power source disposed in the handle for providing power to operate the fan, and a switch coupled with the fan for selectively activating the fan. An inflatable blade has a proximal end with an opening. The proximal end of the inflatable blade is connected to the distal end of the handle. The toy sword may also generate light and sound.

20 Claims, 12 Drawing Sheets

(56) References Cited

U.S. PATENT DOCUMENTS

| | | | |
|---|---|---|---|
| 2009/0093183 | A1 | 4/2009 | Randle et al. |
| 2010/0048097 | A1 | 2/2010 | Ma |
| 2014/0295728 | A1 | 10/2014 | Cayton |

* cited by examiner

INFLATABLE TOYS HAVING INTERCHANGEABLE PARTS

BACKGROUND OF THE INVENTION

Field of the Invention

The present patent application is generally directed to toys and is more particularly directed to inflatable toys having fan assemblies that are activated to inflate the toys.

Description of the Related Art

From the primitive edged weapons used by early humans to those used in the modern world, the history of the sword is a fascinating story. The sword has been used as a fighting weapon, a symbol of authority, a mark of social rank and as a ceremonial object. For centuries, the sword was the weapon of choice for soldiers. Its pre-eminence was secured by a combination of continuous technological improvements and adaptation to ever-changing battlefield conditions.

The Legionaries of the Roman Empire used a short sword called a Gladius sword. The Gladius sword had an average length of 18 to 24 inches long. The primary function of the Roman sword was for thrusting and stabbing in close quarters. Starting in the 11th century in Europe, the wide-bladed and double-edged Saxon broadsword became the inspiration for the early medieval "knightly" sword. In Japan, the rise of the Samurai warrior class during the 12th century saw the development of the Samurai sword. These swords had a complex and ritualized process of manufacturing. China has also had a long history of sword making that stretches back over 3,000 years and includes such indigenous swords as the famous straight-bladed "jian" and the curved-bladed "dao".

Star Wars is an American epic space opera franchise based on a film series created by George Lucas. It depicts the adventures of various characters "a long time ago in a galaxy far, far away." A light saber is a fictional energy weapon featured in the Star Wars films. A typical light saber has a metal hilt usually around 11 inches in length that projects a brightly-lit energy blade usually around 3 feet in length. The light saber is the signature weapon of the Jedi Order and their Sith counterparts. In 2008, a survey of approximately 2,000 film fans found the light saber to be the most popular weapon in film history.

There have been many efforts directed to providing toy swords and sabers. For example, U.S. Pat. No. 7,476,141 to Hom discloses a blade part that is comprised of an elastic plastic balloon, and a handle part that is comprised of a hand pump. The handle part also works as a flash light. The balloon blade is in a contracted state when not in use. When a user wants to use the toy balloon saber, air is pumped into the balloon to tighten the balloon and make it stiff. The flash light is turned on when the saber is used.

U.S. Pat. No. 7,033,242 to Gulmesoff discloses a toy sword having at least one visual or auditory indicator for signaling a user when the sword contacts a target. It functions similar to a fencing point indicator.

U.S. Pat. No. 6,036,602 to Abbott discloses a sparring instrument which allows for safe, pain free, full contact training. The sparring instrument has a handle and a striking portion covered with a bushing armature. The bushing armature is covered by a sheath extending beyond the tip rod. The sheath is made of a soft, resilient material whereby the sheath extends from the end of soft, flexible material when the instrument is bent. The instrument provides a solid training sword covered with soft bushing and cover.

U.S. Pat. Nos. 6,010,435 and 5,295,926 to Tanabe illustrate a bag-shaped sword blade section having a throttled opening formed of a sealing and elastic material such as rubber, which is fitted onto and closely attached to a tip end of a cylindrical-shaped grip formed of a hard material such as wood, a hard rubber, plastics and metals. A gas such as air is filled in the sword blade section.

U.S. Pat. No. 5,947,789 to Chan illustrates a toy sword featuring a handle section housing a light source for illuminating an interior of the blade section and a translucent blade section. The light blinks.

U.S. Pat. No. 5,389,033 to Rauch discloses a toy sword assembly including an elongated blade and handles subpart and a guard part that fits on a guard grasping section of the blade and handles subpart.

U.S. Pat. No. 5,127,871 to Miller teaches a flexible foam 65 sword having a one-piece sword and guard.

U.S. Pat. No. 4,678,450 to Scolari et al. discloses a toy light sword including a hollow blade with a fluorescent coating on the inside that glows when illuminated. It is similar to a Star Wars light saber, however, the sword does not contract.

U.S. Pat. No. 4,080,751 to Copstead teaches a toy sword having a resilient, air-inflatable blade. Means are also provided for securing a rigid handle to the resilient blade. The balloon is inflatable, however, no light is provided.

U.S. Pat. No. 3,807,904 and RE30,894 to Schuman disclose a substantially closed cylinder containing a compressible air or liquid. The passageways are heated along their lengths by an electric bulb which provides sufficient heat energy for sustaining oscillation while providing light for illumination of the surroundings. The light is installed over a head of a cylinder and it has no relation with the piston.

None of the prior art introduces a toy light saber that is safe to use while contracting, expanding and lighting at the same time.

Thus, there remains a need for improved inflatable toy swords and sabers.

SUMMARY OF THE INVENTION

In one embodiment, an inflatable toy sword includes an inflatable blade that may be constructed of materials having different properties and colors. In one embodiment, the inflatable toy sword may have a guard, which represents or depicts a particular era of the sword. In one embodiment, the inflatable toy sword has a fan assembly that is activated to inflate the blade of the sword and maintain the blade in an erect. In one embodiment, an inflatable toy sword may include a sound generating component, a sound chip and/or a light that illuminates the inflatable blade. In one embodiment, the inflatable toy sword has a handle that contains a power source and a multi-position switch to control a fan, a sound chip, and/or light. In one embodiment, the inflatable toy sword has a charger for charging batteries.

In one embodiment, an inflatable toy sword includes a handle having a proximal end and a distal end, a fan disposed in the handle for directing air toward the distal end of the handle, a power source disposed in the handle for providing power to operate the fan, a switch coupled with the fan for selectively activating the fan, and an inflatable blade having a proximal end with an opening, whereby the proximal end of the inflatable blade is connected to the distal end of the handle.

In one embodiment, the inflatable blade is made of a flexible material adapted to hold air or gas. In one embodiment, the inflatable blade is a flexible, elongated balloon. In one embodiment, the inflatable blade is made of polyvinyl chloride (PVC), Mylar®, Latex®, rubber, polyurethane, and/or paper. In one embodiment, the inflatable blade is made of a material that is transparent, semi-transparent, or non-transparent. In one embodiment, the inflatable blade is selected from a material having various colors including red, blue, silver, indigo, and clear.

In one embodiment, the inflatable toy sword has a fan and controller subassembly disposed inside the handle. In one embodiment, the fan and controller subassembly includes a microcontroller that controls operation of the fan. In one embodiment, the microcontroller preferably includes one or more microelectronic circuits or chips that control one or more of a fan, a light source, and a sound generating component.

In one embodiment, the fan and controller subassembly may include an air inlet, the fan, and a light source. In one embodiment, the air inlet provides a source of air to the fan, which, in turn, forces the air into the inflatable blade for inflating the inflatable blade and maintaining the inflatable blade in an erect configuration. In one embodiment, the fan and the light source are desirably in communication with the microcontroller.

In one embodiment, the switch is engagable for activating the fan for inflating the inflatable blade. In one embodiment, the switch is engagable for activating the light source to generate light inside the inflatable blade for illuminating the inflatable blade. In one embodiment, the switch is engageable for activating a sound chip for generating sound effects associated with sword fighting.

In one embodiment, the distal end of the handle has a tube-shaped extension with external threads that surrounds an air-flow opening at the distal end of the handle. In one embodiment, the inflatable toy sword also includes an internally threaded sealing cap that is adapted to mesh with the external threads on the tube-shaped extension.

In one embodiment, the internally threaded sealing cap has a central opening that is adapted to pass over the inflatable blade for securing a proximal end of the inflatable blade to the distal end of the handle.

In one embodiment, the proximal end of the inflatable blade has a lip that surrounds the opening at the proximal end of the inflatable blade. In one embodiment, the lip is disposed over the externally threaded extension for securing the proximal end of the inflatable blade with the distal end of the handle.

In one embodiment, the internally threaded sealing cap is secured over the external threads on the tube-shaped extension for forming an air-tight seal between the proximal end of the inflatable blade and the distal end of the handle.

In one embodiment, an inflatable toy sword does not have sound or light capabilities. In this embodiment, the inflatable toy sword has a fan and an inflatable blade.

In one embodiment, the inflatable blade may be replaced by another flexible, inflatable object such as an inflatable sport object such as an inflatable baseball, football, basketball, soccer ball, etc., having a logo on an outer surface thereof. A light may be disposed inside the inflatable sport object.

In one embodiment, a portable blower may be utilized for inflating an inflatable object or an inflatable blade.

In one embodiment, an inflatable toy sword may have an inflatable paper blade or object that is pre-filled with paper mache. In one embodiment, the inflatable paper blade or object is inflated by a fan or a blower until pressure inside the inflated object bursts the object so that the paper mache shoots out of the blade or object like a party popper device.

In one embodiment, an inflatable toy sword includes a handle having a proximal end and a distal end, a fan disposed in the handle for directing air toward the distal end of the handle, a power source disposed in the handle for providing power to operate the fan, and a switch accessible on the handle and coupled with the fan for selectively activating the fan. In one embodiment, the inflatable toy sword includes a microcontroller disposed in the handle and in communication with the switch and the fan for controlling operation of the fan, and an inflatable blade having a proximal end with an opening, whereby the proximal end of the inflatable blade is connected with the distal end of the handle.

In one embodiment, the inflatable toy sword has a light disposed inside the handle for illuminating the inflatable blade, and a sound generating component disposed inside the handle for generating one or more sounds associated with sword fighting, whereby the light and the sound generating component are in communication with the microcontroller.

In one embodiment, an inflatable toy sword includes a handle having a proximal end and a distal end, a fan disposed in the handle for directing air toward the distal end of the handle, and an inflatable blade having a proximal end with an opening, whereby the proximal end of the inflatable blade is connected with the distal end of the handle, and whereby the fan is aligned with the opening at the proximal end of the inflatable blade for directing air into the inflatable blade. In one embodiment, the inflatable toy sword includes a power source disposed in the handle for providing power to operate the fan, a switch accessible on the handle and coupled with the fan for selectively activating the fan, and a microcontroller disposed in the handle and in communication with the switch and the fan for controlling operation of the fan. In one embodiment, the distal end of the handle has a tube-shaped extension with external threads that surrounds an air-flow opening at the distal end of the handle, and the inflatable toy sword further has an internally threaded sealing cap that is adapted to mesh with the external threads on the tube-shaped extension for forming an air-tight seal between the proximal end of the inflatable blade and the distal end of the handle.

These and other preferred embodiments of the present invention will be described in more detail below.

DETAILED DESCRIPTION

Figure 1:
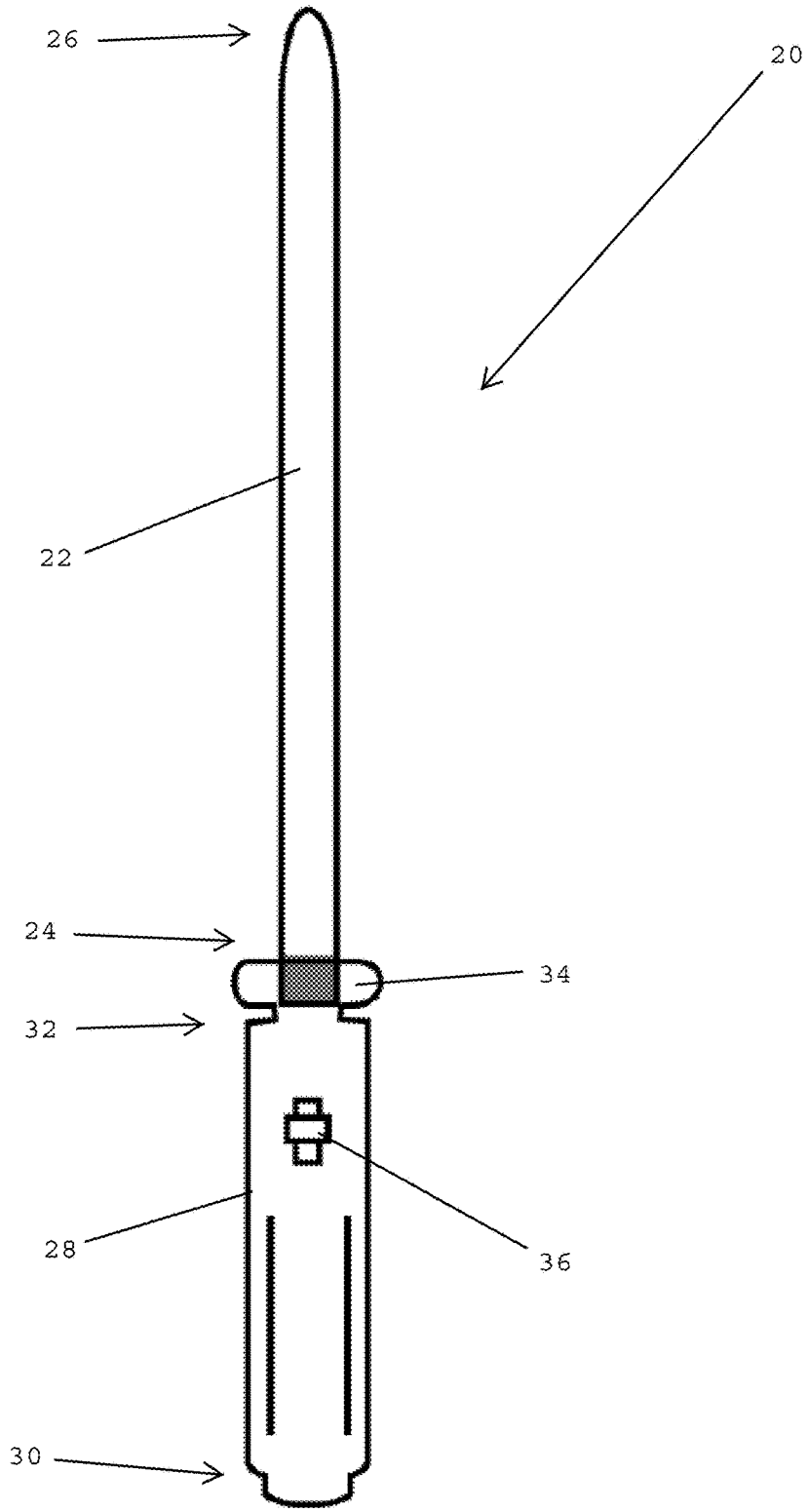
FIG. 1 shows an inflatable toy sword having an inflatable blade, a handle, and a sword guard, in accordance with one embodiment of the invention.

Referring to FIG. 1, in one embodiment, an inflatable toy sword 20 includes an inflatable blade 22 having a proximal end 24 and a distal end 26. The inflatable toy sword 20 has a handle 28 having a proximal end 30, a distal end 32, and a handle guard 34 provided at the distal end 32 of the handle 28. In one embodiment, the inflatable toy sword 20 includes a switch 36 located on the handle 28 for activating the toy sword 20.

Figure 2:
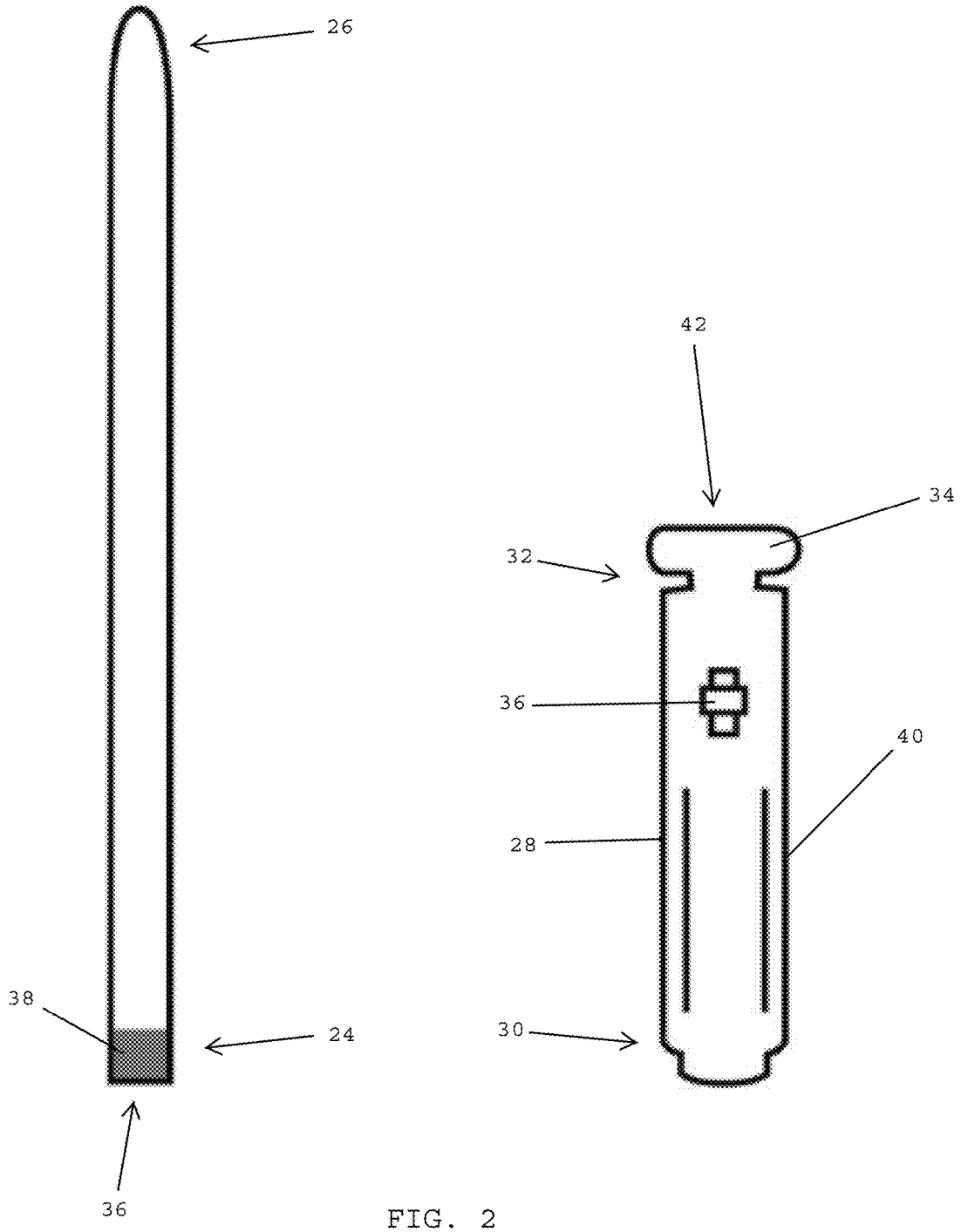
FIG. 2 shows the inflatable blade and the handle of FIG. 1 before the proximal end of the inflatable blade is assembled with the distal end of the handle.

Referring to FIG. 2, in one embodiment, the inflatable blade 22 is made of a flexible material that may hold air or gas and be inflated by directing air or gas into the proximal end 24 of the inflatable sword. In one embodiment, the inflatable blade 22 is a flexible, elongated balloon, which may be made out of various flexible materials including polyvinyl chloride (PVC), Mylar® (i.e., a shiny, foil-like plastic made of polyester), Latex® (i.e., a flexible material made from liquid rubber), polyurethane, and/or or paper. The inflatable blade may be transparent, semi-transparent, or non-transparent. The inflatable blade 22 may have different colors including but not limited to red, blue, silver, indigo, clear, etc. The inflatable blade 22 may have different shapes to replicate different types of swords, e.g., light saber, broadsword, samurai, Chinese Jian, and/or Chinese Dao.

In one embodiment, the distal end 26 and the long sides of the inflatable blade 22 are sealed and the proximal end 24 has an opening 36 for receiving air and/or gas for inflating the inflatable blade 22. In one embodiment, the proximal end 24 of the inflatable blade 22 has a lip 38 that surrounds the opening 36. In one embodiment, the lip 38 is configured to form an air-tight seal with the distal end of the handle 28.

In one embodiment, the inflatable blade has one or more spines 39A, 39B that extend along the long sides of the blade where two sheets of material are sealed together. The spines 39A, 39B may be at the top and bottom of the blade and preferably provide strength and rigidity to the blade when the blade is inflated. The spines may be formed by joining the edges of two opposing sheets together such as by using plastic tape or cloth tape. In one embodiment, the material used to make the inflatable blades may be translucent.

In one embodiment, the handle 28 has a tube-shaped housing 40 that extends between the proximal end 30 and the distal end 32 of the handle. In one embodiment, the handle guard 34 at the distal end 32 of the handle 28 has an opening 42 that is adapted to receive the lip 38 at the proximal end of the inflatable blade 22 for forming an air-tight seal between the distal end 32 of the handle 28 and the proximal end 24 of the inflatable blade 22. The design and configuration of the handle guard 34 and the handle 28 may depict an era or theme for the inflatable toy sword (e.g., Star Wars, Western, Oriental). For example, for a Star Wars era theme, the handle and handle guard may resemble a typical light saber. For a Roman era theme, the handle and handle guard may resemble a Gladius sword. The variations for combining different inflatable blades and handles are limitless.

In one embodiment, the switch 36 on the handle 28 may be a multi-position switch that is accessible at the outer surface of the housing 40. In one embodiment, the switch 36 is located closer to the distal end 32 of the handle 28 than the proximal end 30 of the handle 28. In one embodiment, the switch 36 controls a fan that directed air into the opening 36 at the proximal end 24 of the inflatable blade 22. The switch may also activate sound and/or light, as will be described in more detail herein.

Figure 3:
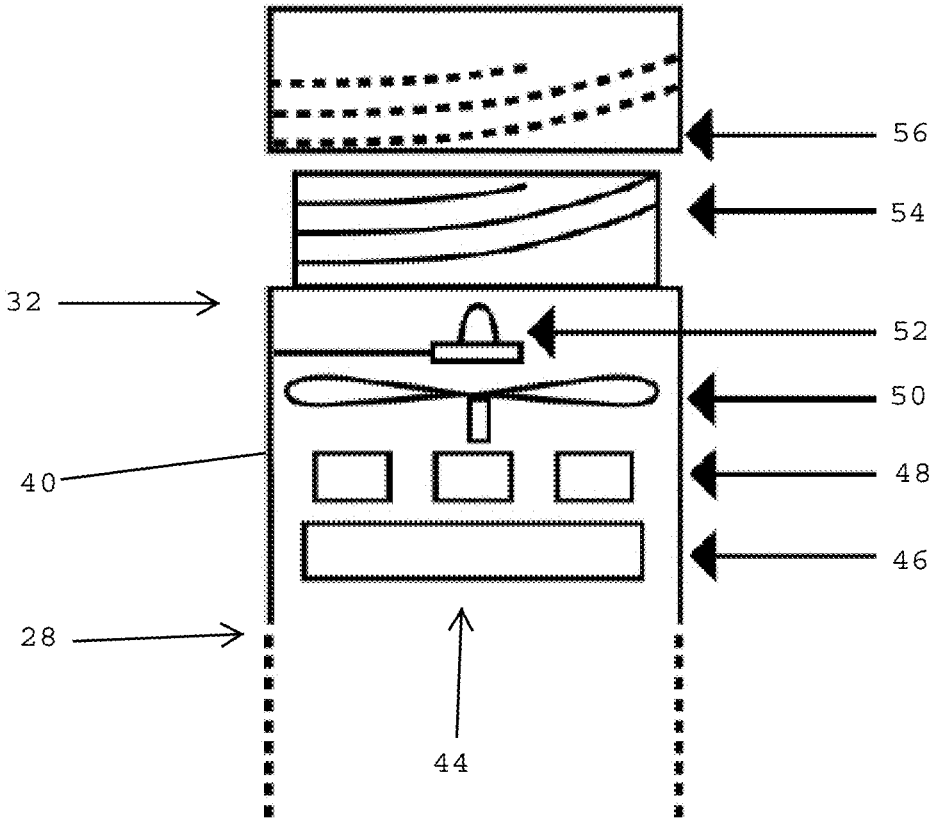
FIG. 3 shows a fan subassembly disposed inside the handle of FIG. 1, in accordance with one embodiment of the invention.

Referring to FIG. 3, in one embodiment, a fan and controller subassembly 44 is disposed inside the housing 40 of the handle 28. In one embodiment, the fan and controller subassembly 44 is disposed adjacent the distal end 32 of the handle 28.

In one embodiment, the fan and controller subassembly 44 desirably includes a microcontroller 46 that controls operation of the inflatable toy sword. In one embodiment, the microcontroller 46 includes one or more microelectronic circuits or chips, which control one or more of a fan, a light source, and a sound generating component for producing various sounds.

In one embodiment, the fan and controller subassembly 44 preferably includes an air inlet 48, a fan 50, and a light source 52 (e.g., an LED light). The fan 44 and the light source 52 are preferably in communication with the microcontroller 46. In one embodiment, the switch 36 (FIG. 2) may be engaged for activating the fan 50 for inflating the inflatable blade 22 (FIG. 2). In one embodiment, the air inlet 48 provides a source of air to the fan 50. In one embodiment, the fan 50 provides air to inflate external devices. In one embodiment, the fan 50 is activated to inflate the inflatable blade 22 (FIG. 2) In one embodiment, the fan may generate sufficient internal pressure to burst the distal end of the inflatable blade and eject paper mache disposed inside the blade. In one embodiment, the fan is a 10 volt, 70 micro-amp fan that rotates at around 0.70 m/s.

The switch 36 (FIG. 2) may also be engaged for activating the light source 52 to generate light and/or for activating a sound chip 46 for generating various sound effects associated with swords and sword fighting.

Referring to FIG. 3, in one embodiment, the distal end 32 of the handle 28 has an externally threaded tube-shaped extension 54 that surrounds the opening 42 (FIG. 2) at the distal end 32 of the handle 28. The inflatable toy sword includes an internally threaded sealing cap 56 that is adapted to mesh with the external threads on the extension 54. The internally threaded sealing cap 56 has a central opening that is designed to pass over the length of an inflatable blade when securing a proximal end of an inflatable blade to a distal end of the handle 28. Referring to FIGS. 2 and 3, in one embodiment, in order to assemble the inflatable blade 22 with the handle 28, the lip 38 at the proximal end 24 of the inflatable blade 22 in disposed over the externally threaded extension 54. The internally threaded sealing cap 56 is tightened over the externally threaded extension 54 for forming an air-tight seal between the proximal end 24 of the inflatable blade 22 and the distal end 32 of the handle 28. In one embodiment, the switch 36 may be engaged for activating the fan 50 for directing air into the inflatable blade 22 for inflating the blade so that it becomes erect. During use of the inflatable toy sword, the fan 50 may be continuously activated for maintaining the inflatable blade 22 is an erect configuration. The switch may also be engaged to generate different types of light effects (e.g., constant, blinking, changing intensity, changing colors, etc.) and different types of sounds (e.g., alerts, alarms, clashing sounds, attack sounds). Other sound effects may replicate blades making contract with other swords, a blade leaving a sheath, etc.

Figure 4:
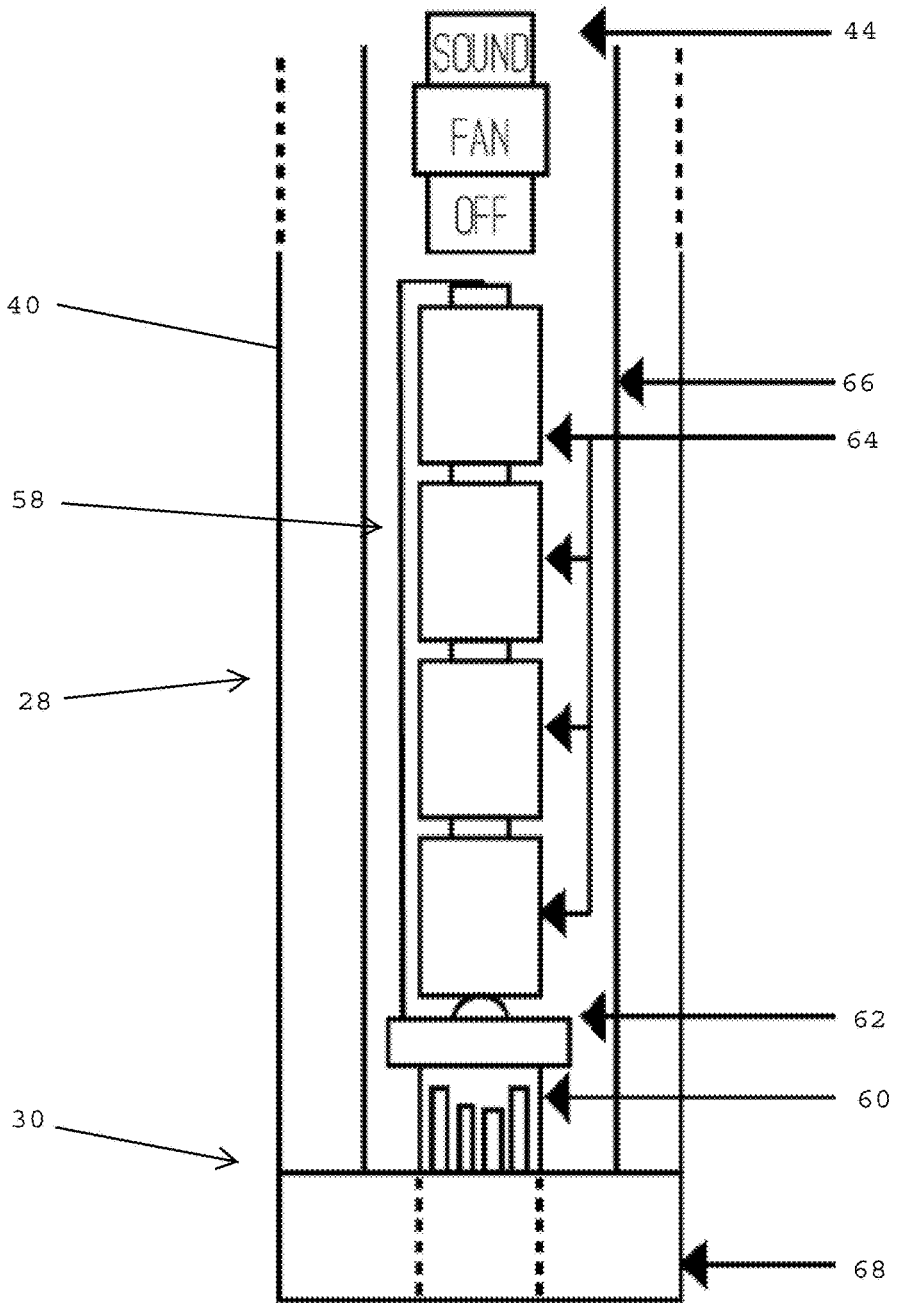
FIG. 4 shows a power subassembly disposed inside the handle of FIG. 1, in accordance with one embodiment of the present invention.

Referring to FIG. 4, in one embodiment, an inflatable toy sword includes a power subassembly 58 disposed inside the housing 40 of the handle 28. In one embodiment, the power subassembly 58 is disposed between the proximal end 30 of the handle 28 and the fan and controller subassembly 44 located adjacent the distal end of the handle 28.

In one embodiment, the power subassembly 58 provides a support base for the fan and controller subassembly. In one embodiment, the power subassembly 58 includes a USB connector 60 that is electrically interconnected with a battery charger circuit 62. One or more rechargeable batteries 64 are provided inside a battery cylinder 66. The batteries 64 are preferably charged and re-charged by connecting with the battery charger circuit 62.

In one embodiment, an end cap 68 covers the proximal end 30 of the housing 40 of the handle 28. The end cap 68 is removable for accessing the components of the power subassembly 58. For example, the end cap 68 may be removed for replacing the batteries 64. In one embodiment, the batteries are any power source that holds an electrical charge. The batteries may be disposable batteries.

Figure 5:
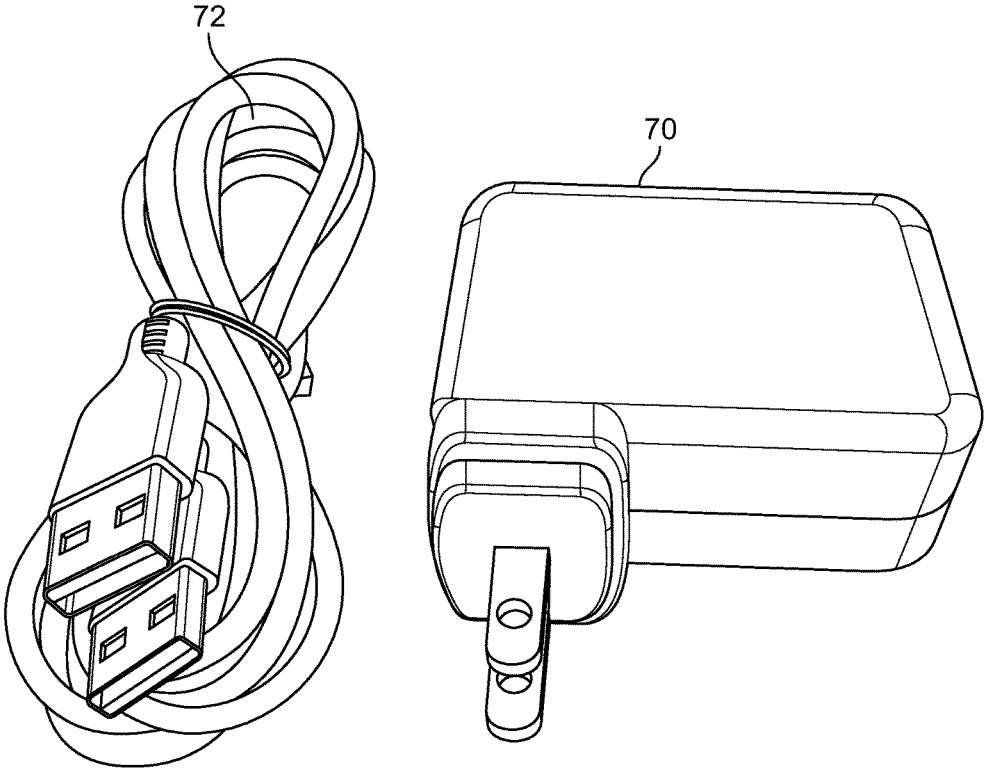
FIG. 5 shows a perspective view of a charger and power cord for providing electrical power to the power and controller subassembly of FIG. 5, in accordance with one embodiment of the present invention.

Referring to FIGS. 4 and 5, in one embodiment, an inflatable toy sword may include an AC adaptor 70 and a power cord 72 that interconnects with the USB connector 60 at the proximal end 30 of the handle 28. In one embodiment, the power cord 72 may be connected with a charging stand that receives the USB connector 60 at the proximal end 30 of the handle 28.

In one embodiment, when the switch 36 is engaged, it will turn on the fan to inflate the inflatable blade, light the inflatable blade and/or generate sounds. In one embodiment, the sword may only inflate without generating light and/or sound.

Figure 6:
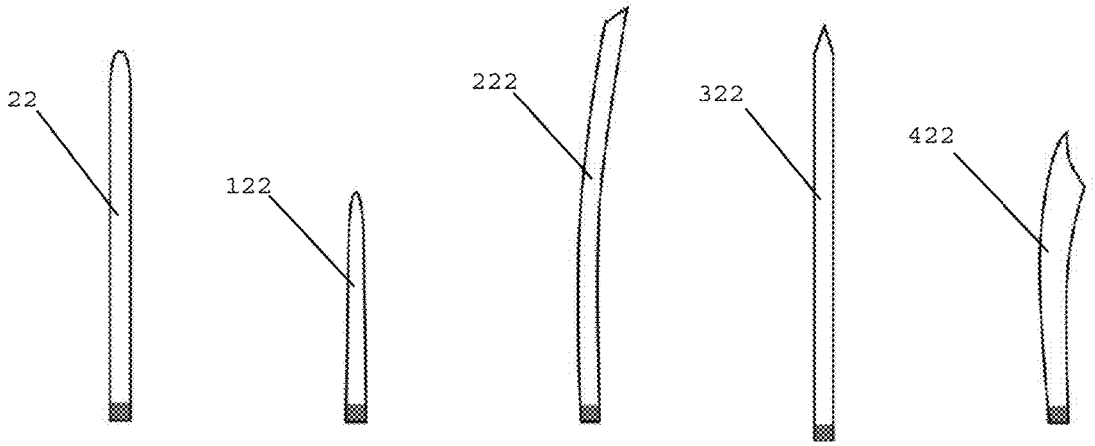
FIG. 6 shows a series of inflatable blades for inflatable toy swords, in accordance with one embodiment of the invention.

Referring to FIG. 6, in one embodiment, an inflatable toy sword may have inflatable blades having different sizes, shapes and configurations to replicate different themes and eras. In one embodiment, the inflatable blades may include a Light Saber blade 22, a Broadsword blade 122, a Samurai blade 222, a Chinese Jian blade 322, and a Chinese Dao blade 422.

Figure 7:
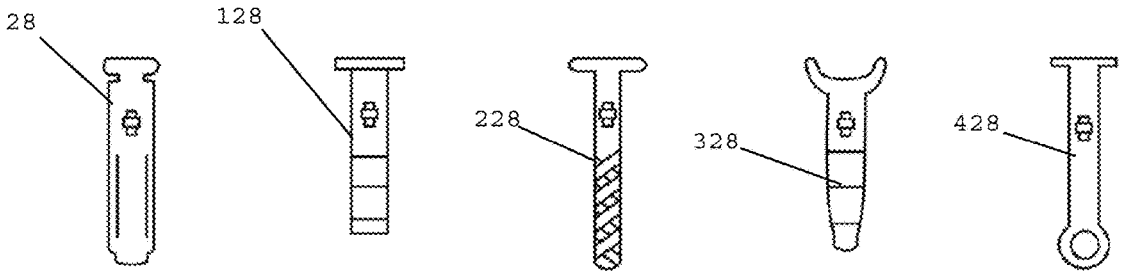
FIG. 7 shows a series of handles for inflatable toy swords, in accordance with one embodiment of the invention.

Referring to FIG. 7, in one embodiment, an inflatable toy sword may have handles having different sizes, shapes and configurations to replicate different themes and eras. In one embodiment, the handles may include a Light Saber handle 28, a Broadsword handle 128, a Samurai handle 228, a Chinese Jian handle 328, and a Chinese Dao handle 428.

In one embodiment, the inflatable blades and the handles shown in FIGS. 6 and 7 may be mixed and matched for creating inflatable toy swords having different appearances. In one embodiment, the Light Saber blade 22 of FIG. 6 may be assembled with any of the handles shown in FIG. 7. In one embodiment, the Broadsword handle 128 of FIG. 7 may be assembled with any of the inflatable blades shown in FIG. 6. In one embodiment, any of the inflatable blades shown in FIG. 6 may be assembled with any of the handles shown in FIG. 7, and any of the handles shown in FIG. 7 may be assembled with any of the inflatable blades shown in FIG. 6. In one embodiment, the inflatable blades and handles shown in FIGS. 6 and 7 may have different shapes and configurations and still father within the scope of the invention.

Figure 8:
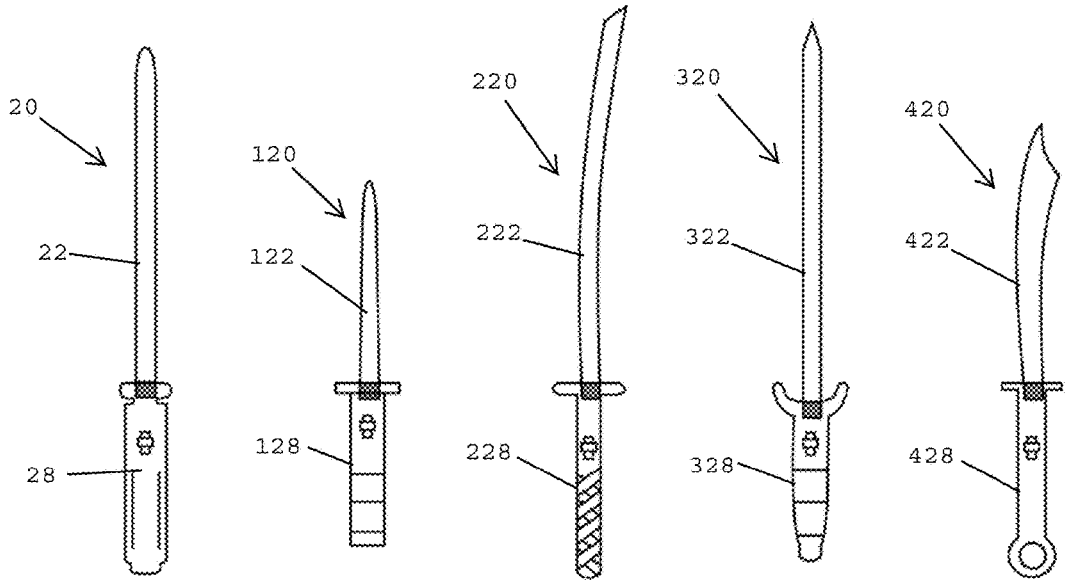
FIG. 8 shows a series of inflatable toy swords having different configurations, in accordance with one embodiment of the invention.

Referring to FIG. 8, in one embodiment, the inflatable blades of FIG. 6 may be assembled with the respective handles of FIG. 7 to provide inflatable toy swords having different configurations that replicate different themes and eras. In one embodiment, an inflatable light saber 20 includes an inflatable light saber blade 22 and a light saber handle 28; an inflatable Boardsword 20 includes an inflatable Boardsword blade 122 and a Boardsword handle 128; an inflatable Samurai sword 220 includes an inflatable Samurai blade 222 and a Samurai handle 228; an inflatable Chinese Jian sword 320 includes an inflatable Chinese Jian blade 322 and a Chinese Jian handle 328, and an inflatable Chinese Dao sword 420 includes an inflatable Chinese Dao blade 22 and a Chinese Dao handle 428. The different inflatable blades of FIG. 6 may be mixed and matched with the different guards shown in FIG. 7 to assemble swords having different configurations. The present application contemplates that inflatable blades and guards having different sizes, shapes and configurations may be used.

Figure 9:
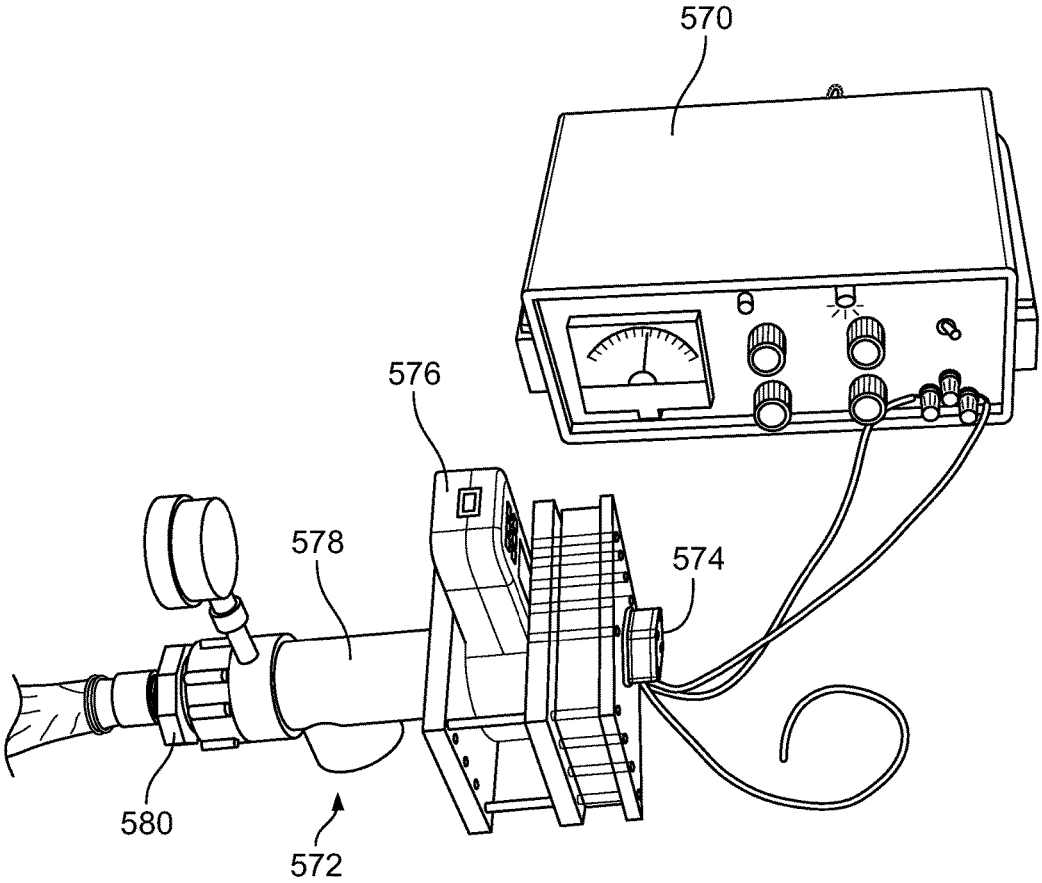
FIGS. 9-11 show a system for testing an inflatable toy sword, in accordance with one embodiment of the invention.
Figure 10:
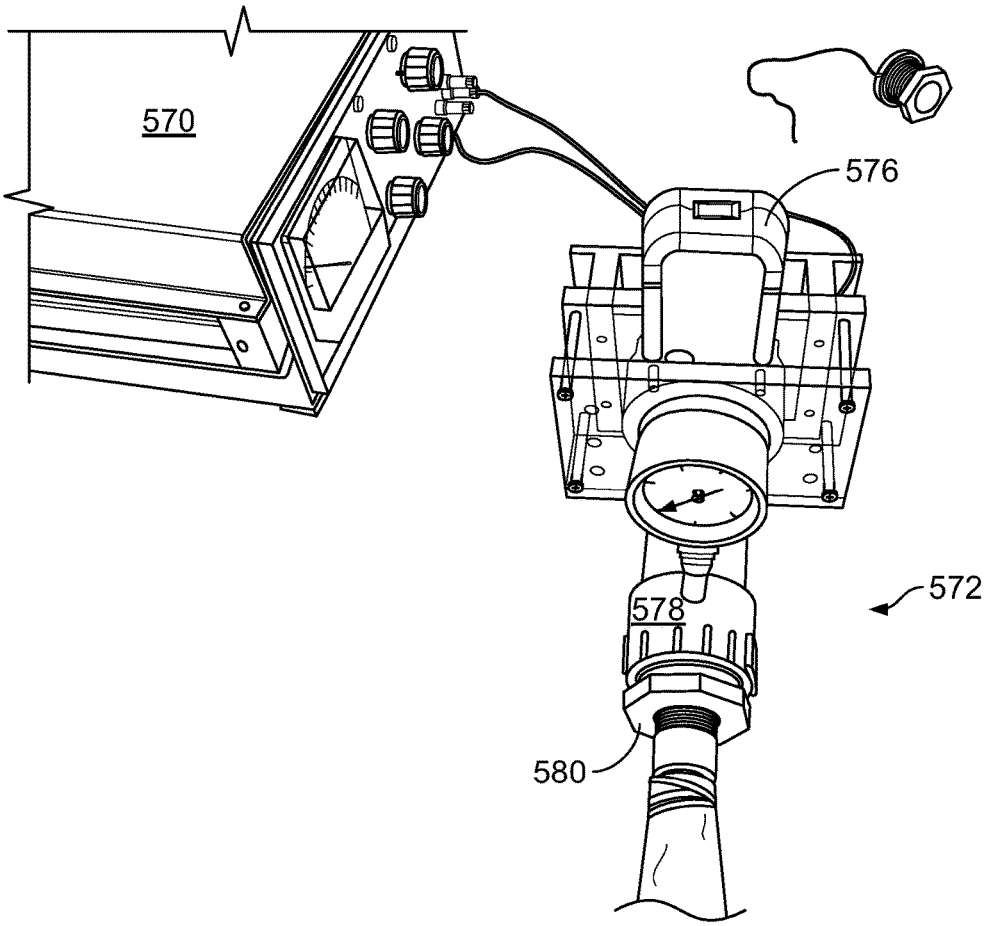
Figure 11:
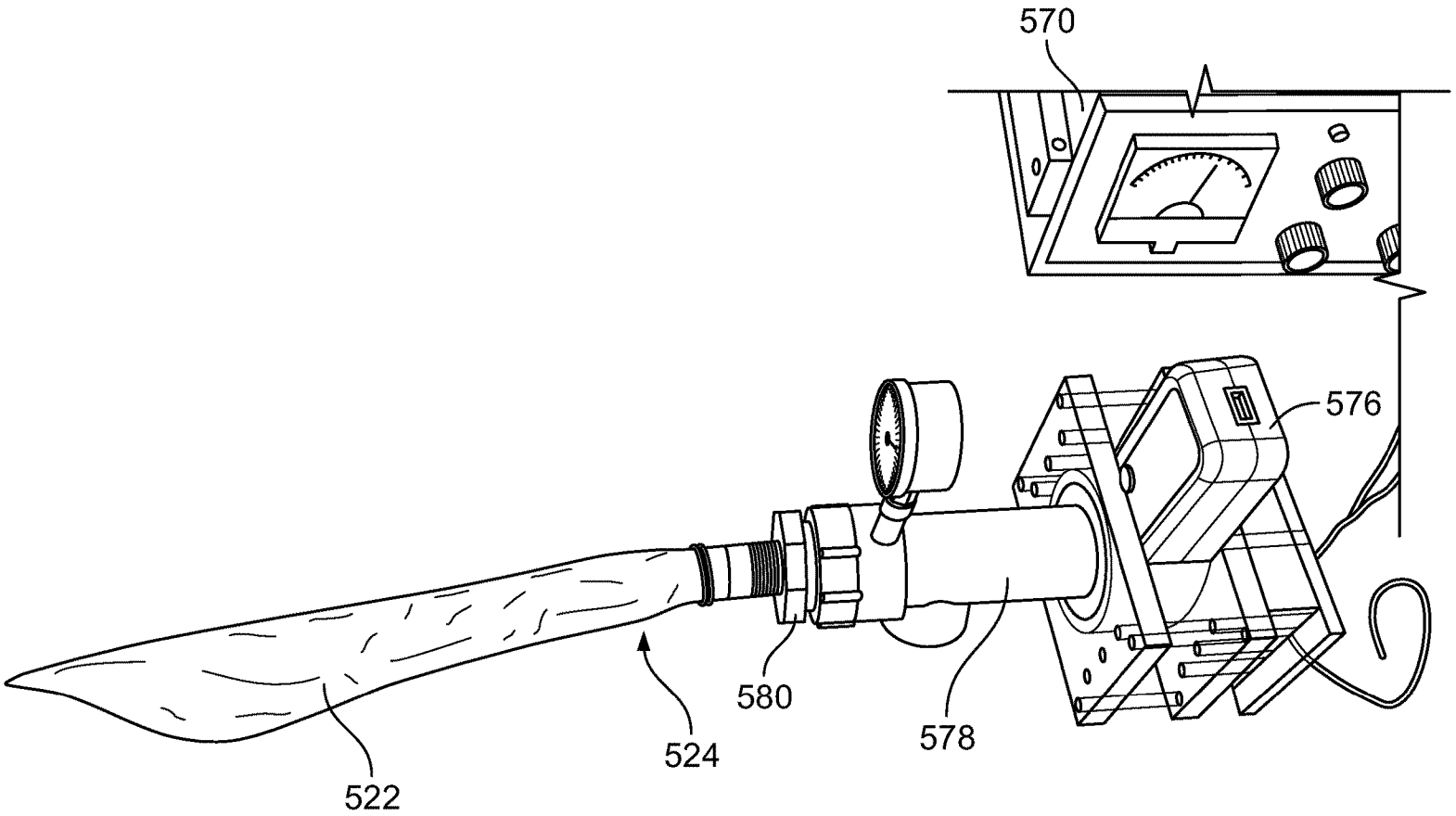

Referring to FIGS. 9-11, in one embodiment, a system for testing an inflatable toy sword comprises a transformer 570 that generates electrical power for a test station 572 having a fan 574, an air flow meter 576, an air chamber 578, and an air-tight connection 580 at the distal end of the air chamber 578. In one embodiment, a proximal end 524 of an inflatable blade 522 is connected to the distal end of the air chamber 578 using the air-tight connection 580. The inflatable blade 522 may be made of any of the flexible materials disclosed herein. In one embodiment, an air pressure meter may be used instead of or in conjunction with the air flow meter for monitoring the pressure level of the air inside the inflatable blade.

Figure 12A:
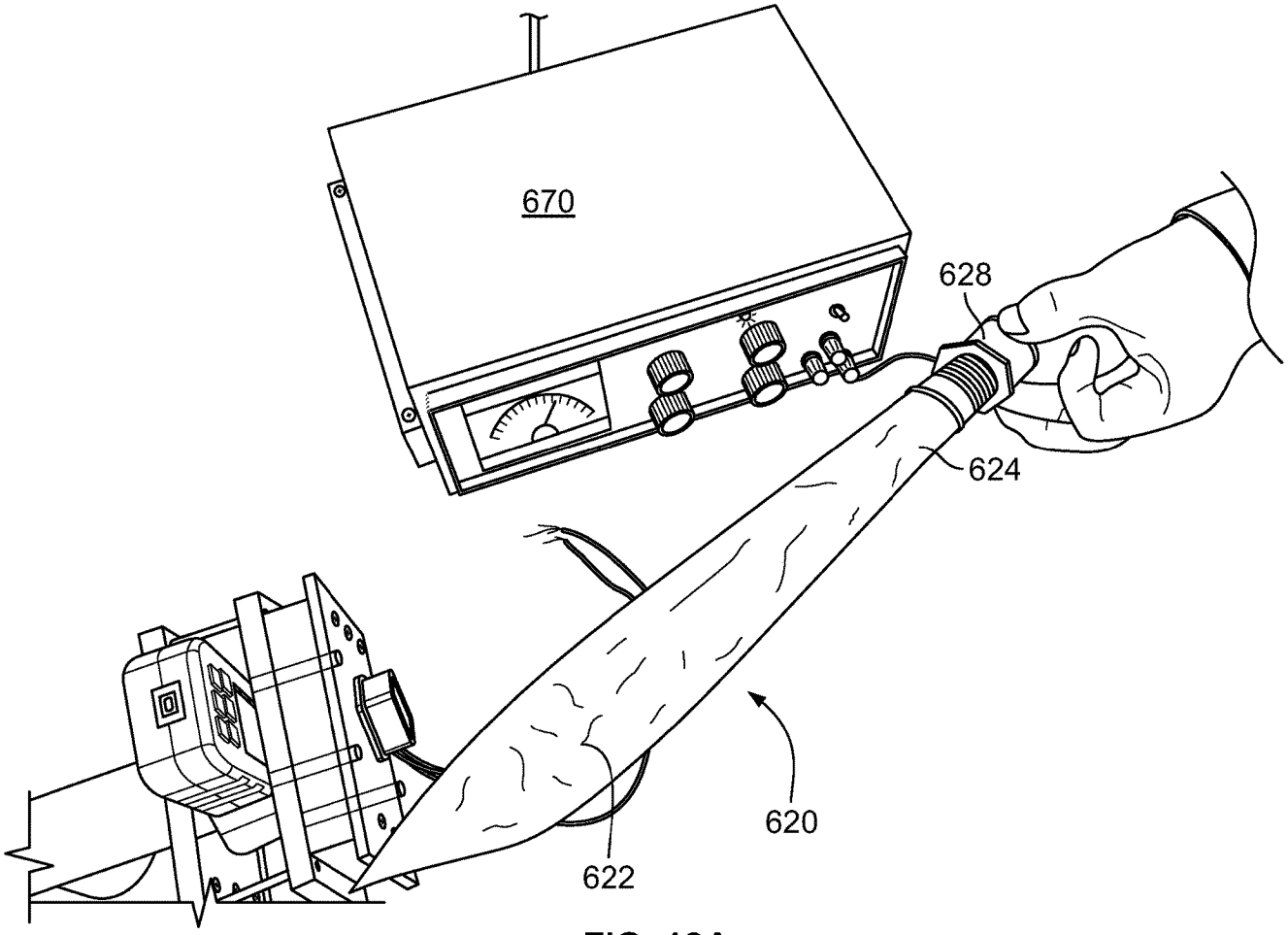
FIGS. 12A and 12B show another system for testing an inflatable toy sword, in accordance with one embodiment of the present invention.
Figure 12B:
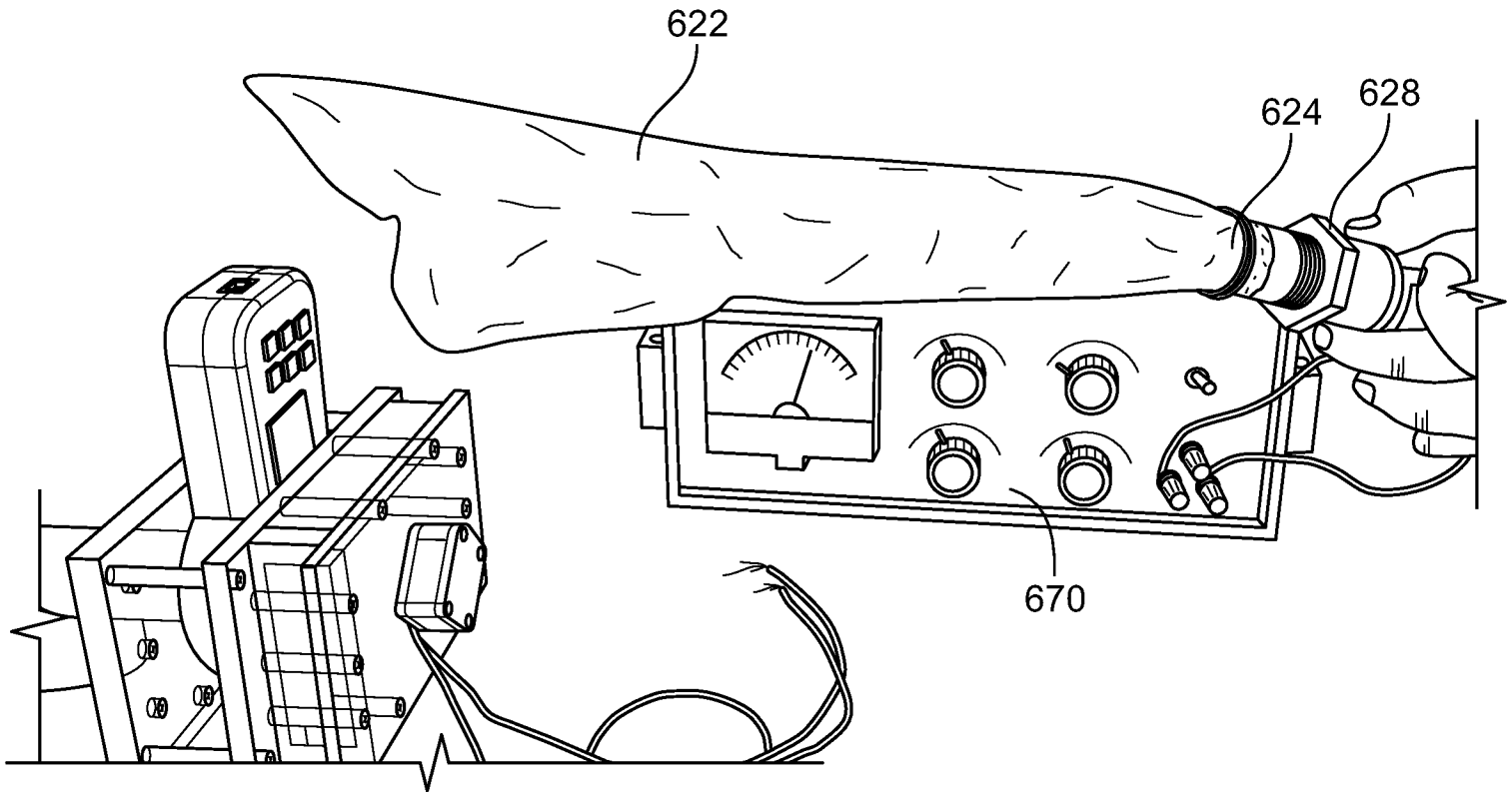

Referring to FIGS. 12A and 12B, in one embodiment, a system for testing an inflatable toy sword 620 includes a transformer 670 that generates low voltage electricity for operating a fan (not shown) disposed inside a handle 628. A proximal end 624 of an inflatable blade 622 forms an air-tight connection with a distal end of the handle 628. The transformer provides power to the fan in the handle 628 for inflating the inflatable blade 622.

In one embodiment, the switch on the handle is a two position switch. The first position is a single pole, single throw switch, which functions to turn on the light and the fan to inflate the inflatable blade. In one embodiment, the fan can be a fixed speed fan or a variable speed fan depending on the desired inflation level for the blade. In one embodiment, the fan generates positive air pressure to inflate and erect the inflatable blade and maintain the erect configuration and shape of the blade. When the switch is in the off position, the fan and light will turn off and the blade will deflate. In one embodiment, the second position of the switch controls sound. When the switch is engaged, a sound corresponding to the style of the saber guard may be played. There can be numerous saber guards, such as Star Wars, Western, or Oriental. If a Star Wars saber guard is inserted, it plays the Star Wars light saber sound. If a Western or Oriental guard is inserted, the sound of the sword leaving its sheath is played. In one embodiment, each saber guard has the ability to generate a customized unique sound with the sound chip that is in the handle.

In one embodiment, the inflatable blade has a thickness of between about 0.3 mm to 1.0 mm. The blade material may be transparent, semi-transparent, or non-transparent. The blade material may be any color such as red, blue, silver, or indigo.

While the foregoing is directed to embodiments of the present invention, other and further embodiments of the invention may be devised without departing from the basic scope thereof, which is only limited by the scope of the claims that follow. For example, the present invention contemplates that any of the features shown in any of the embodiments described herein, or incorporated by reference herein, may be incorporated with any of the features shown in any of the other embodiments described herein, or incorporated by reference herein, and still fall within the scope of the present invention.

What is claimed is:

1. An inflatable toy sword comprising:

a handle having a proximal end and a distal end;

a fan disposed in said handle for directing air toward the distal end of said handle;

a power source disposed in said handle for providing power to operate said fan;

a switch coupled with said fan for selectively activating said fan;

an inflatable blade having a proximal end with an opening, wherein the proximal end of said inflatable blade is connected to the distal end of said handle.

2. The inflatable toy sword as claimed in claim 1, wherein said inflatable blade comprises a flexible material adapted to hold air or gas.

3. The inflatable toy sword as claimed in claim 1, wherein said inflatable blade comprises a flexible, elongated balloon.

4. The inflatable toy sword as claimed in claim 1, wherein said inflatable blade is a material selected from the group consisting of polyvinyl chloride (PVC), Mylar®, Latex®, rubber, polyurethane, and paper.

5. The inflatable toy sword as claimed in claim 1, wherein said inflatable blade is a material selected from the group consisting of transparent, semi-transparent, and non-transparent materials.

6. The inflatable toy sword as claimed in claim 1, wherein said inflatable blade is a material having a color selected from the group consisting of red, blue, silver, indigo, and clear.

7. The inflatable toy sword as claimed in claim 1, further comprising a fan and controller subassembly that is disposed inside said handle, said fan and controller subassembly including a microcontroller that is in communication with said switch and for controlling operation of said inflatable toy sword.

8. The inflatable toy sword as claimed in claim 7, wherein said microcontroller comprises one or more microelectronic circuits or chips that control one or more of a fan, a light source, and a sound generating component.

9. The inflatable toy sword as claimed in claim 8, wherein said fan and controller subassembly further comprises an air inlet, said fan, and a light source, and wherein said fan and said light source are preferably in communication with said microcontroller.

10. The inflatable toy sword as claimed in claim 9, wherein said switch is engagable for activating said light source for illuminating said inflatable blade.

11. The inflatable toy sword as claimed in claim 10, wherein said switch is engageable for activating a sound chip for generating sound effects associated with sword fighting.

12. The inflatable toy sword as claimed in claim 1, wherein the distal end of said handle has a tube-shaped extension with external threads that surrounds an air-flow opening at the distal end of said handle, said inflatable toy sword further comprising an internally threaded sealing cap that is adapted to mesh with the external threads on said tube-shaped extension.

13. The inflatable toy sword as claimed in claim 12, wherein said internally threaded sealing cap has a central opening that is adapted to pass over said inflatable blade for securing the proximal end of said inflatable blade to the distal end of said handle.

14. The inflatable sword as claimed in claim 13, wherein the proximal end of said inflatable blade has a lip that surrounds the opening at the proximal end of said inflatable blade, and wherein the lip is disposed over the externally threaded extension for securing the proximal end of said inflatable blade with the distal end of said handle.

15. The inflatable toy sword as claimed in claim 14, wherein said internally threaded sealing cap is secured over the external threads on said tube-shaped extension for forming an air-tight seal between the proximal end of said inflatable blade and the distal end of said handle.

16. An inflatable toy sword comprising:

a handle having a proximal end and a distal end;

a fan disposed in said handle for directing air toward the distal end of said handle;

a power source disposed in said handle for providing power to operate said fan;

a switch accessible on said handle and coupled with said fan for selectively activating said fan;

a microcontroller disposed in said handle and in communication with said switch and said fan for controlling operation of said fan;

an inflatable blade having a proximal end with an opening, wherein the proximal end of said inflatable blade is connected with the distal end of said handle.

17. The inflatable toy sword as claimed in claim 16, further comprising:

a light disposed inside said handle for illuminating said inflatable blade;

a sound generating component disposed inside said handle for generating one or more sounds associated with sword fighting, wherein said light and said sound generating component are in communication with said microcontroller.

18. The inflatable toy sword as claimed in claim 16, wherein said inflatable blade comprises a flexible material adapted to hold air or gas, and wherein said inflatable blade is a material selected from the group consisting of polyvinyl chloride (PVC), Mylar®, Latex®, rubber, polyurethane, and paper.

19. The inflatable toy sword as claimed in claim 16 wherein the distal end of said handle has a tube-shaped extension with external threads that surrounds an air-flow opening at the distal end of said handle, said inflatable toy sword further comprising an internally threaded sealing cap that is adapted to mesh with the external threads on said tube-shaped extension.

20. An inflatable toy sword comprising:

a handle having a proximal end and a distal end;

a fan disposed in said handle for directing air toward the distal end of said handle;

an inflatable blade having a proximal end with an opening, wherein the proximal end of said inflatable blade is connected with the distal end of said handle, and wherein said fan is aligned with the opening at the proximal end of said inflatable blade for directing air into said inflatable blade;

a power source disposed in said handle for providing power to operate said fan;

a switch accessible on said handle and coupled with said fan for selectively activating said fan;

a microcontroller disposed in said handle and in communication with said switch and said fan for controlling operation of said fan;

wherein the distal end of said handle has a tube-shaped extension with external threads that surrounds an air-flow opening at the distal end of said handle, said inflatable toy sword further comprising an internally threaded sealing cap that is adapted to mesh with the external threads on said tube-shaped extension for forming an air-tight seal between the proximal end of said inflatable blade and the distal end of said handle.

* * * * *